US005266057A

United States Patent [19]

Angel, Jr. et al.

[11] Patent Number: 5,266,057

[45] Date of Patent: Nov. 30, 1993

[54] ELECTRONIC POWER DISTRIBUTION DEVICE

[75] Inventors: Donald E. Angel, Jr., Oakland; David H. Pitcher, Menlo Park; Matthew S. Harvey, San Francisco, all of Calif.

[73] Assignee: Monster Cable Products, Inc., South San Francisco, Calif.

[21] Appl. No.: 861,085

[22] Filed: Mar. 31, 1992

Related U.S. Application Data

[63] Continuation-in-part of Ser. No. 687,382, Apr. 18, 1991, Pat. No. 5,100,348, and a continuation of Ser. No. 502,103, Mar. 29, 1990, abandoned.

[51] Int. Cl.[5] ..... H01R 4/36

[52] U.S. Cl. ..... 439/724; 439/798; 439/431; 411/393

[58] Field of Search ..... 439/723, 798, 810, 394, 439/416, 814, 427, 428, 429, 431; 403/362; 411/393

[56] References Cited

U.S. PATENT DOCUMENTS

| | | | |
|---|---|---|---|
| 902,235 | 10/1908 | Kellner | 439/805 |
| 1,943,660 | 1/1934 | Edwards | 439/798 |
| 2,156,272 | 5/1939 | Bell | 439/428 |
| 2,839,595 | 6/1958 | Felts et al. | 439/427 |
| 3,577,114 | 5/1971 | Hawkins | 439/798 |
| 3,668,609 | 6/1972 | Link | 439/411 |
| 3,989,400 | 11/1976 | Smith et al. | 439/428 |
| 4,050,770 | 9/1977 | Rigo | 439/17 |
| 4,163,597 | 8/1979 | Brenholts | 439/428 |
| 4,214,806 | 7/1980 | Kraft | 439/723 |

FOREIGN PATENT DOCUMENTS

| | | | |
|---|---|---|---|
| 401773 | 12/1945 | Italy | 439/798 |
| 931823 | 7/1963 | United Kingdom | 411/393 |

*Primary Examiner*—Gary F. Paumen

*Attorney, Agent, or Firm*—Rosen, Dainow & Jacobs

[57] ABSTRACT

An electronic power distributor is provided. The distributor is a cylindrical base unit shaped like a hockey puck which contains a top surface, bottom and side circular surfaces. In the top surface, there are a number of holes which extend into the base unit. These holes have a threaded portion for engaging with a power bolt. The side circular surface contains a number of holes which extend into the base unit and are positioned to perpendicularly intersect the holes which extend from the top surface. The holes on the side are capable of receiving the strands of a wire conductor or an adapter of other size conductors. The power bolts which hold the wire conductors in the holes through the side circular surface contain three portions. The first portion is conical and contain a first annular beveled surface extending radially and axially generally toward the vertex. The second portion contains a second annular beveled surface adjacent the threaded portion and extending radially and axially toward the vertex, a third portion having an annular beveled surface between the first and the second annular surfaces extending radially and axially toward the vetex. The angle of the first annular portion is about the same angle as the angle of the second annular portion but the third annular surface is angled greater than that of the first and second. In this design, the conic portion bores through the strands of wire at an equal force to cause the stands to separate and spread along the annular beveled surfaces of the screw. The power puck contains a clear encasing to protect it from the outside environment.

26 Claims, 7 Drawing Sheets

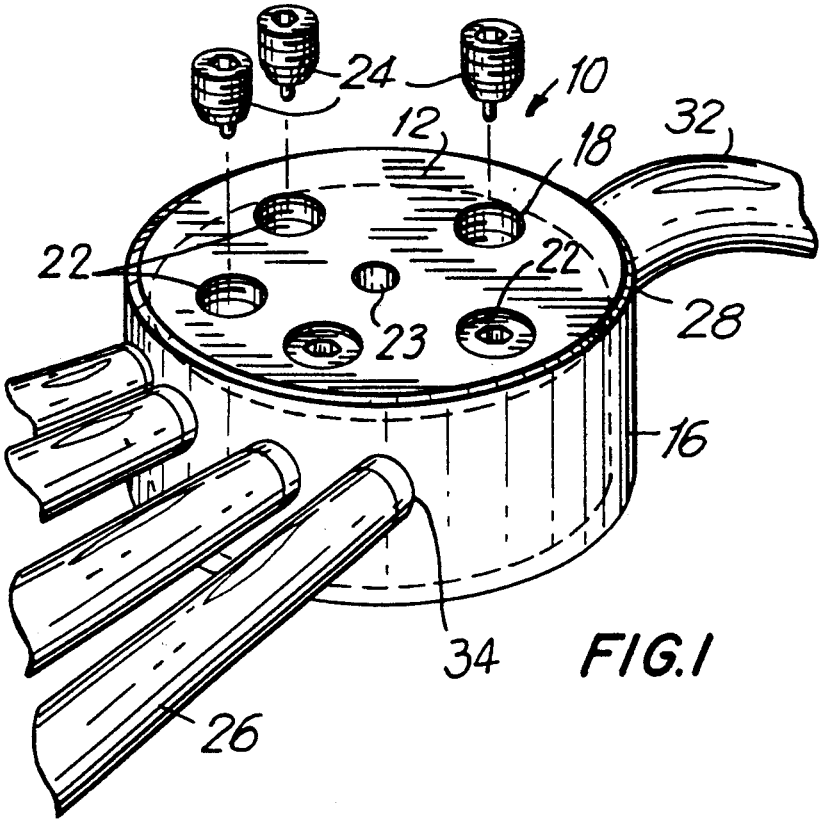
FIG. 1
FIG. 2
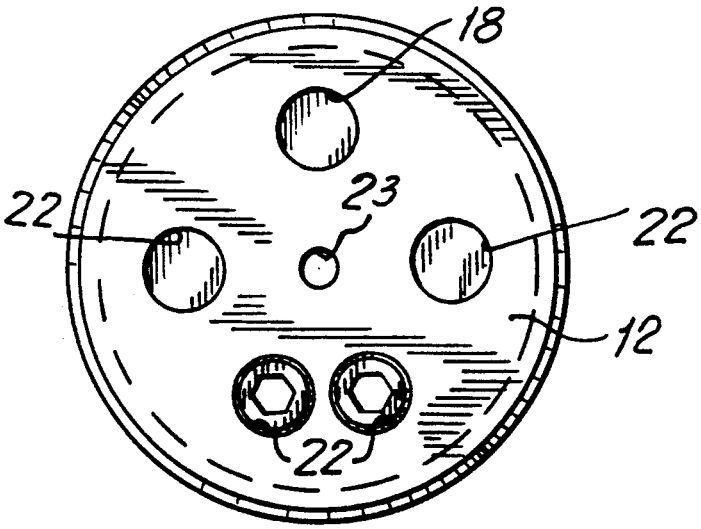

ELECTRONIC POWER DISTRIBUTION DEVICE

This application is a continuation-in-part of the application Ser. No. 07/687,382 filed Apr. 18, 1991, now U.S. Pat. No. 5,100,348 issued Mar. 31, 1992, and a continuation of the parent application Ser. No. 07/502,103 filed Mar. 29, 1990, now abandoned.

FIELD OF THE INVENTION

The present invention relates to electronic power distribution devices and more particularly to the use of such devices in a vehicle high fidelity system.

BACKGROUND OF THE INVENTION

The high fidelity industry has long recognized the importance and need of a long lasting, high performance, easy to install power distribution products that can handle the enormous demands a vehicle stereo system places on a power distribution system. Such power systems not only must exceed the standards of high performance and reliability, they must be simple to manufacture and inexpensive to produce.

Conventional power distribution devices however are limiting at best. They are inadequately engineered for true high current carrying demands. Typically, these systems are large in size and often require assembly. This makes installation more time consuming and difficult, especially where space is limited.

Typically, conventional devices are usually manufactured in the shape of a rectangle or square from a square stock, i.e., square bar. When machining the square stock, the threaded holes are drilled in the ends of the square stock. However, in order to properly drill the threaded holes in the sides of the square stock and to chamfer all of the edges, the square stock must be taken off of the machine to accomplish this task. For economy as well as ease of manufacturing, it is desirable for manufacturers to have a design that allows some of the machining to be automated on one machine such as a screw or computer numerical control (CNC) machine. A traditional square design requires more interface or human handling. In addition, it is desirable to have a design that requires less metal to manufacture. The additional metal is more costly and it does not improve the overall power distribution of the device.

The conventional devices have other disadvantages. First, some fail to obtain a high integrity electrical connection. That is, the connection between the wire conductors and the power distribution device is not secure. When a wire conductor is inserted in an opening in the device, its strands (up to 1000 or more in a 4 gauge cable) lay flush on a flat or indented spherical surface. The wire is secured to the device by a screw which clamps down on the strands of the wire conductor. Typically, the screw contains a flat head for this connection.

Since the strands of the wire are held in place by the force of the flat head against the conductor, some strands are spread away from the bundle and other strands never even contact the screw entirely. That is, the contact force is large but makes minimal surface contact. When the device vibrates or moves as a result of vehicle movement, e.g., a bump, etc., the individual strands of the wire will move farther away from the bundle of strands around the edge of the screw. This decrease in the integrity of the connection results in a voltage drop due to the build up from increased contact resistance. In addition, the wire conductors may eventually fully separate from the power distribution device.

The quality of the stereo system will not only decrease as a result of a known large voltage drop because of the poor connection but because such a voltage drop will not satisfy the standards of the International Auto Sound Challenge Association (IASCA). This association sets standards for which automobile owners/dealers must comply in order to enter their cars in automobile shows.

IASCA's rules dictate a maximum allowable voltage drop from the connection of the battery to the amplifier located in the rear of the car. The voltage drop cannot exceed 0.5 volts. IASCA sets this voltage drop at 0.5 volts so that the amplifier will operate at an optimal level. That is, since the amplifier undergoes deep transients as in sudden calls for deep bass tones, it will require high current inrushes. The resultant large voltage drop caused by contact resistance can cause an amplifier to be less efficient.

Other conventional devices obtain secure connection using an external compressible sleeve surrounding a stranded wire conductor. U.S. Pat. No. 902,235 to Kellner shows on example of this type of device. However, manufacturing the sleeve increases cost and does not improve the ultimate contact between the stranded wires and the connector surface. In addition, the collet or sleeve often cannot be reused once it is accessed.

A second disadvantage of the conventional power distribution devices is that they are open to wear and abrasion as a result of the outside conditions in the vehicle. Most do not have a strong abrasion free housing to prevent dirt from accumulating on the wire connections on the device. Such a housing can prevent significant power loss by preventing such dirt from accumulating on the connection areas of the device. U.S. Pat. No. 4,050,770 shows a junction box for terminating electrical power conductors. However, in order to fasten the wire conductors to the junction terminals, the entire housing is exposed to the outside environment. Consequently, dirt and oil from the vehicle accumulates on the open connection areas.

A third disadvantage of the conventional power distribution devices is their height. Most installers require the lowest profile distributor for aesthetic reasons as well as IASCA rules.

Accordingly, it is an object of the present invention to provide a power distribution device for use in vehicle stereo systems which solves the aforementioned problems.

SUMMARY OF THE INVENTION

The present invention solves the above and related objects by providing a novel and unique construction for a power distribution device. In accordance with the preferred embodiment of the present invention, the device is shaped as a bilaterally truncated cylinder, like a hockey puck, and preferably constructed of brass. Such a design is less costly and easier to manufacture. Since brass is easily produced in the shape of a cylindrical bar, it therefore requires little cutting to form the shape of a puck. Thus, less machining is needed. Further, since the device contains no square edges, less metal is required. The puck is gold plated for preventing corrosion and wear on the device. Since an autosound environment, as in a vehicle, is subject to salt and other corrosive chemicals, the additional protection is an important feature.

The puck design allows it to be flush mounted, without preassembly or without the use of an installation boot. This simplifies installation, thereby saving time and effort. The puck design also fits neatly into any installation and is easy to access when retro-fitting or repairing since no further assembly is required.

Another feature of the invention is that it is equipped with a uniquely designed power screw, preferably gold plated. This screw contains an end portion that is conically shaped. The end portion has three different angled annular beveled surface areas. This conic surface is specifically engineered to exert even pressure on all of the strands of a wire conductor and spread the strands along the three annular beveled surfaces. That is, maximum contact surface area by means of a conical surface creates even contact vector forces.

Even pressure forces on the strands provides a constant securing force on the strands along the beveled surfaces and therefore provides greater contact between the strands and the surface area of the screw. Greater contact is extremely beneficial in order to reduce contact resistance and thus heat loss. In addition, even pressure caused by the arrangement of the three annular surfaces locks the strands of the conductor in place without damaging them. As a result, a long lasting, corrosion free, high integrity connection is obtained.

The invention is also provided with of a clear polycarbonate housing surrounding the entire device for protection against electrical short circuits, mechanical impact and extreme temperature variations.

In accordance with another embodiment of the present invention, the inventive structure is provided with an eccentric hole for clamping the device to a battery terminal. If the hole was concentric, i.e., the hole having a common center with that of the puck, adjacent terminals would cause interference and would prevent proper clamping. In this embodiment, the structure includes a slit extending from the inside of the eccentric hole to the outside of the puck. A screw is provided to close the slit and tighten the inventive structure to the battery terminal.

This embodiment not only features the power screw described above, but features a removable connection adapter. Such an adapter is not only capable of connecting the battery cable to the inventive structure, but may also be removed quickly to clean or replace the cable leads.

BRIEF DESCRIPTION OF THE DRAWINGS

FIG. 1 is a perspective view of the power distribution device in accordance with the present invention;

FIG. 2 is a top view of the power distribution device illustrated in FIG. 1;

DETAILED DESCRIPTION OF THE PREFERRED EMBODIMENT

Figure 3:
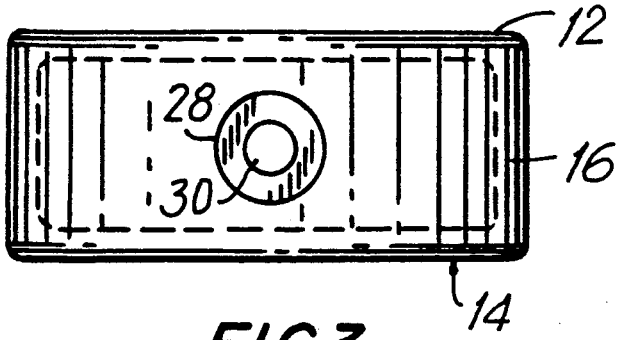
FIG. 3 is one side view of the power distribution device illustrated in FIG. 1.

Referring to FIG. 1, there is shown a perspective view of the power distribution device or power puck 10 according to the present invention. The power puck 10 is made of brass inside and covered with 24K gold plate on the outside. The power puck 10 is designed to be cylindrically shaped. This shape is preferred for a number of reasons. First, and most important, since brass is generally machined on its radial axis, machining can be more automated. Therefore, cost is reduced because less machining operations are needed to manufacture the power puck 10. Second, because there are no square edges, less metal is wasted. Third, because of the unique one piece shape, the puck can be flush mounted, without preassembly or without the use of an installation boot. Consequently, installation time is reduced and mechanical complexities eliminated. Fourth, this shape fits neatly into any installation, and is easy to work with if retro-fitting or troubleshooting. The 24K exterior gold plate provides for maximum corrosion resistance.

As seen from FIGS. 1 and 2, the power puck 10 includes a conductive base unit having a top surface 12 (first surface), bottom surface 14 (third surface, not shown), and a circular surface 16 (second surface), between the top 12 and bottom 14 surfaces. This circular surface 16 defines the cylindrical shape of the power puck 10. The power puck 10 contains a first formed opening or hole 18 through the top surface 12 extending into the power puck 10. The inner surface which defines the first hole 18 contains a threaded portion and a generally spherical portion at the bottom of the hole 18.

The power puck 10 also contains a first plurality of holes 22 through the top surface 12 and extending into the power puck 10. Holes 18, 22 do not extend completely through the power puck 10. That is, holes 18,22 are blind holes. The inner surface that defines each hole of the first plurality of holes 22 contains a threaded portion adjacent the first top surface 12 and a generally spherical portion at the end of the hole. The spherical portions of the first hole 18 and the first plurality of holes 22 are present as a result of a standard drill bit. However, different manufacturing techniques can produce holes without a spherical portion. In these figures, the first plurality of holes 22 consists of 4 holes. However, almost any number of holes can be used to achieve power distribution needs. A further hole 23 serves as a center mounting hole, and is formed completely through the power puck 10.

Figure 5:
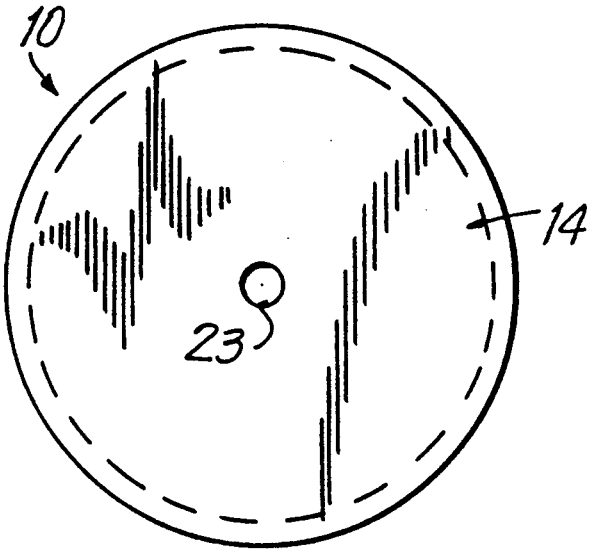
FIG. 5 is a bottom view of the device illustrated in FIG. 1.

As seen in FIG. 3, showing a rear view of FIG. 1, the circular surface 16 contains a second hole 28 therethrough and extending into the power puck 10. The second hole 28 is positioned to perpendicularly intersect the first hole 18. The second hole 28 contains a shoulder section 30 to prevent the insulation of a stranded wire 32 from entering the second hole 28. The second hole 28 is made large enough to accommodate a 4 gauge wire. However, any size hole can be used, only limited by the length of the circular surface 16 from the top surface 12 to the bottom surface 14 (shown in FIG. 5).

Figure 4:
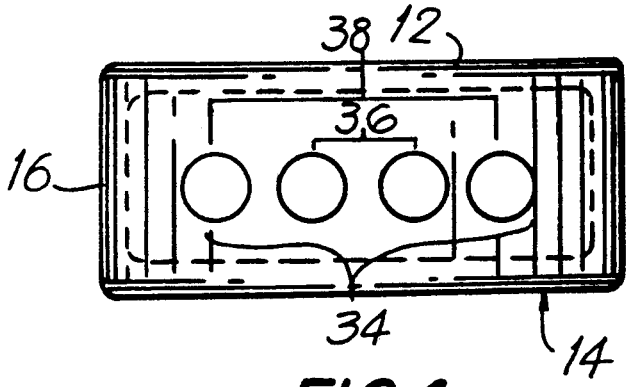
FIG. 4 is another side view of the distribution device illustrated in FIG. 1.

The power puck 10 also contains a second plurality of holes 34 through the circular surface 16 extending into the power puck 10. The holes 28, 34 are also blind holes. In FIGS. 1 and 4, the second plurality of holes 34 consist of two inner holes 36 and two outer holes 38. The second plurality of holes 34 are located generally opposite the second hole 28 and are positioned to perpendicularly intersect the first plurality of holes 22. In order to allow all stranded wire conductors 26 to be mounted perpendicularly with respect to the surface 16 of the puck 10, the outside holes 38 on the circular surface 16 must be drilled at the same angle toward the puck 10 as the inner holes 36.

Figure 6:
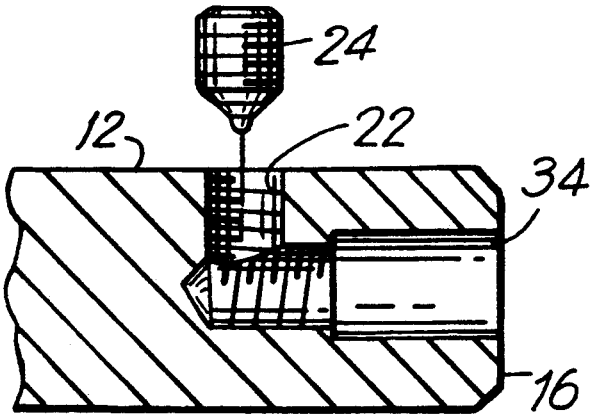
FIG. 6 is a cross sectional view of the two intersecting holes including the power screw of the present invention.
Figure 6A:
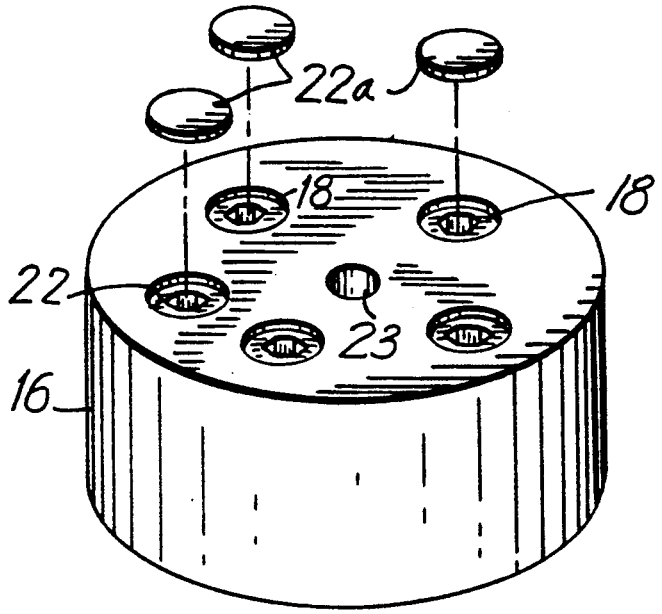
FIG. 6A is a perspective view of the housing.

FIG. 6 is a cross sectional view of a hole 22 from the top surface 12 and a hole 34 from circular surface 16 which intersects hole 22. It also shows a power screw 24 according to the present invention. In this illustration, the threads of the hole 22 can be clearly seen. FIG. 6A shows a perspective view of the polycarbonate housing and the small coverings 22A to fit over the screws. These coverings will be discussed below.

FIG. 6B shows a cross section of the power puck 10, showing hole 23, hole 28 and hole 18.

Figure 7A:
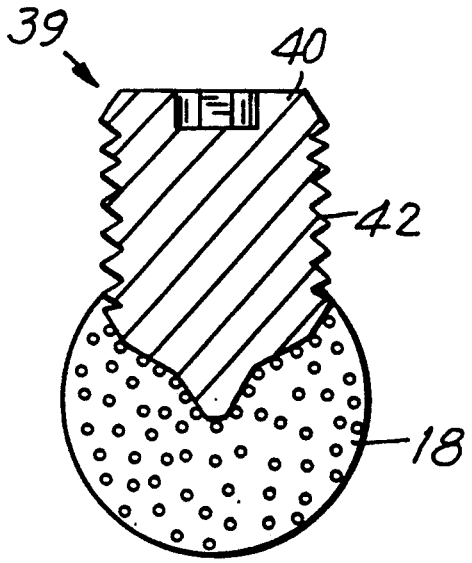
FIG. 7A is a cross sectional view of the power screw fully inserted in a hole with a wire conductor inserted therein.
Figure 7:
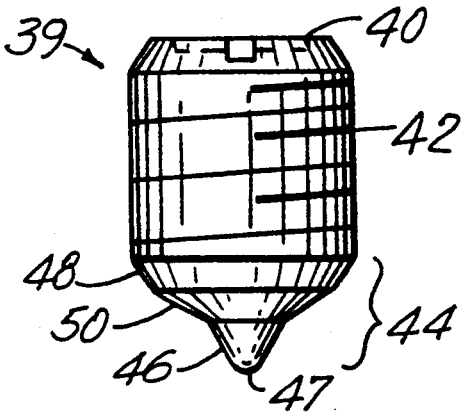
FIG. 7 is an enlarged side view of the power screw shown in FIG. 6.

FIG. 7 shows an enlarged side view of a power screw 39, similar to power screws 24 shown in FIGS. 1 and 6. The power screw 39 contains a head 40 specially manufactured to accommodate a driver, such as a phillips head, flat head, or an allen wrench. The power screw 39 contains a threaded portion 42 to engage with the threaded portions of either the first hole 18 or any of the first plurality of holes 22.

The screw 39 also contains a bullet shaped section 44 at the end of the power screw 39, opposite the bead 40. The bullet shaped section 44 contains three portions. The first portion 46 is a conic portion which contains a first annular beveled surface. This first annular beveled surface extends axially and radially toward the vertex 47 of the conic portion. The second portion 48 is adjacent the threaded portion 42 and contains a second beveled annular surface which extends axially and radially toward the vertex 47.

The third portion 50 is located between the first and second portions 46,48. The third portion 50 has a third annular beveled surface which extends radially and axially from the second portion 48 to the first portion 46. The third annular beveled surface is designed to have a larger slope or angle (toward the vertex 47) than the first or second annular surfaces. The first annular beveled surface of the conic portion has a slightly steeper angle toward the vertex 47 than the second annular beveled surface. This is the preferred shape of the bullet head 44. It provides a maximum surface contact between the screw and the strands of the wire conductor as described below. However, a number of different annular beveled surfaces with different angle measures are possible within the spirit of the invention.

The function of the first annular beveled surface of the conic portion 46 is to bore through the strands of wire (typically about 1500 strands) when the power screw is positioned against the cable end and cause them to part and spread along the first, second and third annular beveled surfaces of the first, second and third portions 46,48, respectively, sandwiching the strands between the end of the power screw and its associated orthogonally aligned hole in which the end of the conductors are inserted. Such a design creates a uniform connection between the strands of the wire conductor, the screw 39, and the walls of its associated hole. Consequently, contact resistance is reduced and therefore, heat loss is also reduced. In addition, this design providing equal pressure exerted on the strands substantially reduces or eliminates conductor damage.

In FIG. 7A, there is shown an enlarged cross sectional view of the screw 39 fully inserted hole 18 against the strands of a wire conductor inserted in the hole 28. The strands are evenly distributed along the three annular beveled surfaces of the conic portions as a result of the even force vectors created by the annular beveled surfaces.

Figure 5A:
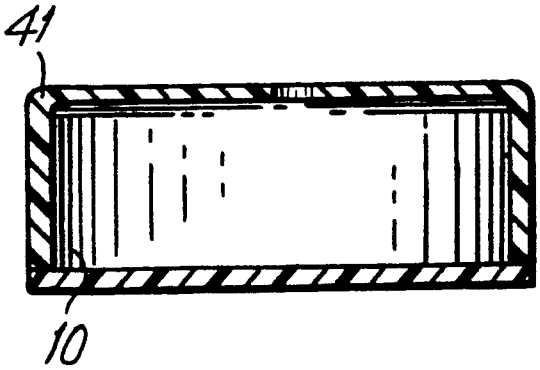
FIG. 5A shows the distributor of FIG. 1 having a case enclosure.

The power puck 10 has a housing 41 (see FIG. 5A) completely surrounding the puck. The housing 41 has openings aligned with the holes on the top and side circular surfaces of the puck to permit the conductors to enter the puck and to permit the tightening of all of the bolts. The housing 41 is preferably made of clear polycarbonate for its durability when the puck is exposed to environmental conditions as well as when it is subjected to shock or vibration. Once the bolts inserted in the holes in the top surface are fully tightened, there are small coverings, 22A, FIG. 6A made of a softer plaster material fitted in the openings of the housing above the bolts and thus sealing the unit. The softer material is used so that it is easy to remove.

Figure 8:
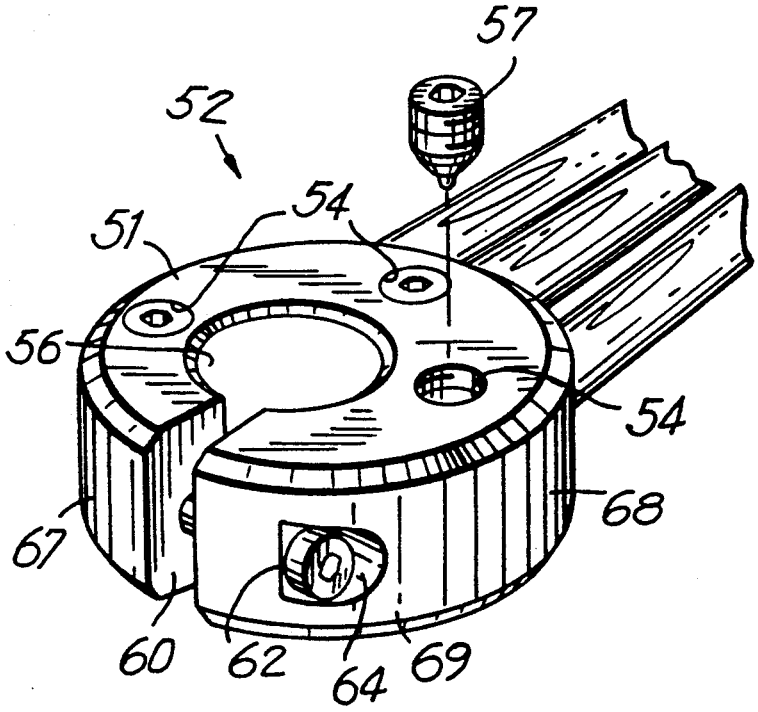
FIG. 8 is a perspective view of another embodiment of the power distribution device of the present invention.
Figure 9:
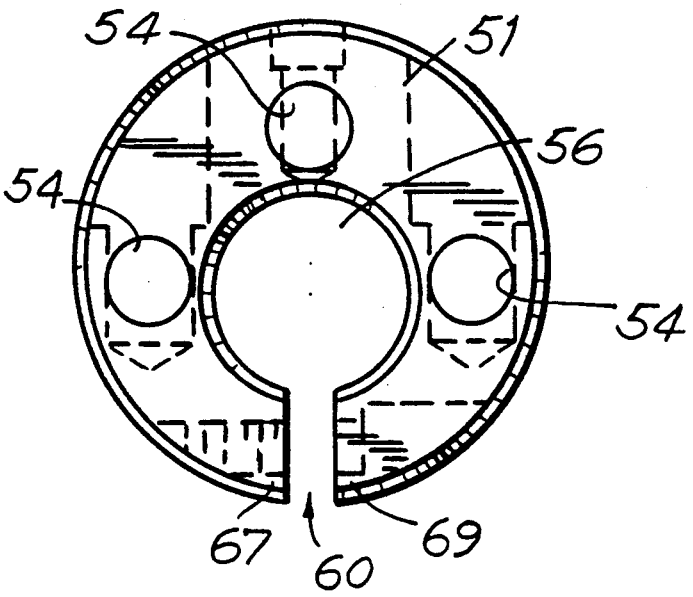
FIG. 9 is a top view of the device illustrated in FIG. 8.

FIG. 8 is a perspective view of another embodiment according to the invention of the power distribution device or battery puck 52 suitable for attachment directly to the battery used in a motor vehicle. As shown in FIGS. 8 and 9, the top surface 51 of the battery puck 52 contains a first plurality of holes 54 through the top surface 51 extending into but not through the puck 52. The battery puck 52 also contains a second plurality of holes 66 through the side surface 68 extending into the battery puck 52. The second and first plurality of holes 54,66 are positioned to perpendicularly intersect each other, respectively. The holes 54,66 are blind holes. Each hole of the first plurality of holes 54 contains a threaded portion for receiving the power screw 57 as described above, in a manner similar to these described in the power puck embodiment.

The battery puck 52 also contains center hole 56 for receiving a battery terminal. The hole 56 may be tapered to accomodate a tapered battery terminal so that the battery puck 52 can fit on a battery terminal, thus maximizing contact area. The battery puck 52 also contains a slit 60 which extends from the inside of the hole 56 through a portion of the battery puck 52 to the outside surface 68. The hole 56 may be located off center in the puck 52 to maximize the location of the hole area while still providing sufficient material on the opposite side to make firm contact.

Figure 11:
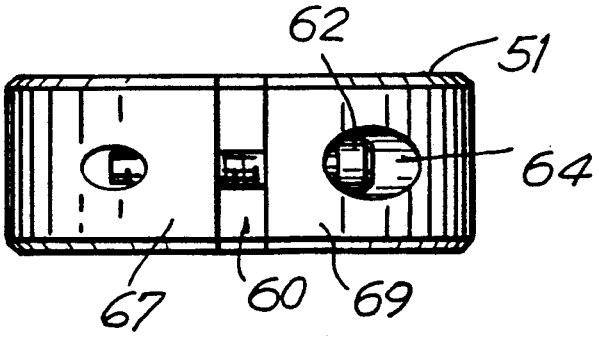
FIG. 11 is another side view of the device illustrated in FIG. 8.

As best seen in FIG. 9, the shape of the battery puck resembles the letter "C." Referring to FIGS. 9 and 11, the resulting "C" has two side positions 67 and 69 forming the slit 60. The battery puck also contains a clamping hole 64 through the circular surface 16. The clamping hole 64 extends from one portion 67 of the "C" to the other portion 69 through the slit 60. The clamping hole 64 through each arm has an inner surface which contains a threaded portion through 65. A clamping screw 62 is turned to engage with the threaded portion 65 and cause the side portions 67, 69 to pull together to close the center hole 56 and tighten the battery puck around the battery terminal.

Figure 10:
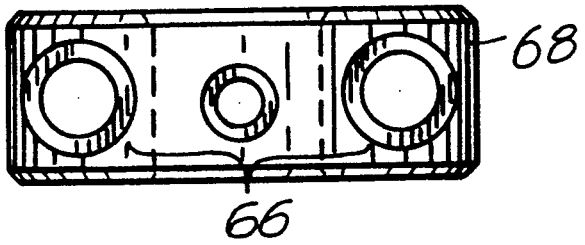
FIG. 10 is one side view of the device illustrated in FIG. 8.

FIG. 10 shows a side view of the battery puck 52. In this view, the three holes 66 can be seen more clearly. The two outside holes are designed to be large enough to receive a battery wire or a removable adapter (discussed below). The center hole is smaller for connecting wires that run through the vehicle to high fidelity equipment.

Figure 12:
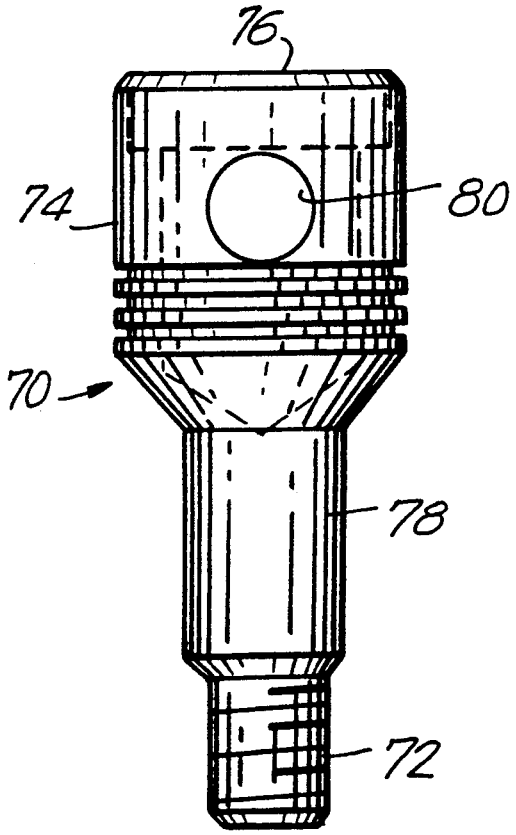
FIG. 12 is a side view of the battery cable adapter of the present invention.

In FIG. 12, there is shown a removable adapter 70. It contains a threaded first portion 72 at one end to engage with the threads of either outside hole 66 of the circular surface 16. The removable adapter 70 also contains a second portion 74 having a hole 76 large enough to receive a heavy current cable such as a starter cable. The second portion 74 is separated from the first portion 72 by a solid third portion 78. The second portion 74 contains a plurality of holes 80 equally spaced on the surface of the second portion 74. These holes are capable of receiving power screws, such as described above to secure the battery cable to the adapter 70. The battery puck 52 is also protectable by means of a polypropylene plastic housing which may be used fully or partially to enclose the exposed areas of the puck 52 from corrosive environmental factors.

While an illustrative and presently preferred embodiment of the invention has been described in detail herein, it is to be understood that the inventive concepts of the invention may be otherwise variously embodied and employed, and that the following appended claims are intended to be construed to include such variations.

I claim:

1. An electrical power distributor for retaining stranded wire conductors, comprising:

a conductive base unit having a first and second surface, said base unit further having a first opening in said first surface of said base unit and extending therein, said opening having an inner surface, said inner surface having a threaded portion, and a second opening in said second surface of said base unit and extending therein, for accommodating a stranded wire conductor, a first bolt having a threaded portion for engaging with said threaded portion of said first opening, said bolt including an end portion of conical shape including a contacting annular beveled surface, said end portion contacting a plurality of strands of said wire conductor inserted in said base unit and causing said strands to spread throughout said second opening along said annular beveled surface thereby maximizing electrical contact between the stranded cable and the base unit, said first bolt further having a second portion between said threaded portion and said end portion, said second portion having a second annular beveled surface extending axially and radially inwardly toward said end portion, and a third portion between said second portion and said end portion, said third portion having a third beveled annular surface extending axially and radially toward said end portion.

2. The invention of claim 1, wherein said base unit further includes:

a first plurality of openings through said first surface and extending into said base unit, said first plurality of openings having an inner surface, each inner surface having a threaded portion;

a second plurality of opening in said second surface of said base unit for accommodating stranded wire conductors;

a plurality of bolts, each bolt having a threaded portion for engaging with said threaded portion of said first plurality of openings, respectively, and an end portion having a conical shape and including a first annular beveled surface, said end portion contacting said plurality of strands of a wire conductor inserted in said base unit and causing said strands to spread throughout said second plurality of openings along said first annular beveled surface.

3. The invention of claim 2, wherein said plurality of bolts further each having a second portion between said threaded portion and said end portion, said second portion having a second annular beveled surface extending axially and radially inwardly toward said end portion.

4. The invention of claim 3, wherein said plurality of bolts further having a third portion between said second portion and said conic end portion, said third portion having a third beveled annular surface extending axially and radially toward said conic end portion.

5. The invention of claim 4, wherein said conductive base unit has a third surface between said first and second surfaces defining a cylindrical shape.

6. The invention of claim 5, wherein said second surface having a second opening extending in said conductive base unit and positioned to intersect said first opening.

7. The invention of claim 6, wherein said second plurality of openings extending in said conductive base unit, positioned generally opposite said second opening and positioned to intersect said first plurality of openings.

8. The invention of claim 7, wherein said second opening being larger than said second plurality of openings.

9. The invention of claim 8, wherein said second opening having a shoulder for preventing insulation on a wire conductor from entering said solid base unit.

10. The invention of claim 1 further comprising an insulating housing surrounding said conductive base unit, said housing having an opening aligned over said first opening.

11. The invention of claim 10, wherein said conductive base unit having a third opening extending from said first to said third surfaces completely through said base unit and said housing having openings aligned over said opening extending through said base unit.

12. The invention of claim 1, further comprising a removable adapter for connecting a battery wire to said conductive base unit.

13. The invention of claim 1, wherein said first bolt further having a top portion with an opening for receiving one of said flat head screw driver, phillips head screw driver, and allen wrench head.

14. The invention of claim 1 wherein said base unit has the shape of a puck.

15. The invention of claim 1, wherein said conductive base unit having a opening extending completely through the base unit and said housing.

16. An electrical power distributor for connecting a plurality of stranded wire conductor comprising:

a cylindrical conductive base unit having a first surface and second surface; and means in said first surface for retaining stranded wire conductors in said second surface and an insulating housing surrounding said base unit, said housing having openings aligned over said means for retaining said wire conductors, said base unit comprises a first opening through said first surface and extending into said base unit and having an inner surface, said inner surface having a threaded portion, and said power distributor further comprising a first bolt having a threaded portion for engaging with said threaded portion of said opening and an end portion having a first annular beveled surface, a second portion between said threaded portion and said end portion having a second beveled annular surface extending axially and radially inward toward said end portion; and a third portion between said second and end portions, said third portion having a third beveled annular surface extending axially and radially toward said end portion, said first annular beveled surface of said end portion bores through a plurality of strands of a wire conductor inserted in said base unit and causing said strands to spread along said first annular beveled surface.

17. The invention of claim 15, wherein said base unit further comprising:

a plurality of openings through said first surface and extending into said base unit, said plurality of openings each having an inner surface, said inner surface having a threaded portion; and a plurality of bolts, each having a threaded portion for engaging with said threaded portion of said inner surface of said plurality of openings, respectively, and a end portion having a first annular beveled surface, said first annular beveled surface of said end portion bores through a plurality of strands of a wire conductor inserted in said base unit and causing said strands to spread along said first annular beveled surface.

18. The invention of claim 15, wherein said insulating housing having openings aligned over said first opening and said plurality of openings.

19. The invention of claim 18, wherein said conductive base unit further having third surface opposite said first surface, said second surface being between said first and second surfaces and defining said cylindrical shape of said base unit.

20. The invention of claim 19, wherein said second surface having a second opening extending in said conductive base unit and positioned to intersect said first opening.

21. The invention of claim 20, wherein said second surface further having a second plurality of openings extending in said conductive base unit, positioned generally opposite said second opening and positioned to intersect said first plurality of openings.

22. The invention of claim 21, wherein said second opening being larger than said second plurality of openings.

23. The invention of claim 22, wherein said second opening having a shoulder for preventing insulation on a wire conductor from entering said solid base unit.

24. The invention of claim 23, wherein said first and second openings being perpendicular and said first and second plurality of openings being perpendicular.

25. An electrical power distributor for retaining stranded wire conductors, comprising:

a conductive base unit having a first and second surface, a first opening in said first surface and extending in said base unit, and a second opening in said second surface of said base unit and extending therein for accommodating a stranded wire conductor, said first opening having an inner surface with a threaded portion, a first bolt having a threaded portion for engaging with said threaded portion of said first opening, said bolt including an end portion including a contacting annular beveled surface, said end portion contacting a plurality of strands of said wire conductor inserted in said base unit and causing said strands to spread throughout said second opening along said annular beveled surface thereby maximizing electrical contact between the stranded cable and the base unit, said first bolt further having a second portion between said threaded portion and said end portion, said second portion having a second annular beveled surface extending axially and radially inwardly toward said end portion, and a third portion between said second portion and said end portion, said third portion having a third beveled annular surface extending axially and radially toward said end portion.

26. The invention of claim 25 wherein said end portion having a conical shape.

* * * * *